US008403323B2

(12) United States Patent
Rutten et al.

(10) Patent No.: US 8,403,323 B2
(45) Date of Patent: Mar. 26, 2013

(54) SHEET STACKING DEVICE AND METHOD OF STACKING SHEETS

(75) Inventors: Stan H. L. A. Rutten, Eindhoven (NL); Johannes H. A. Dinnissen, Venlo (NL); Robertus P. C. Quirijnen, Velden (NL)

(73) Assignee: Oce Technologies B.V., Venlo (NL)

( * ) Notice: Subject to any disclaimer, the term of this patent is extended or adjusted under 35 U.S.C. 154(b) by 0 days.

(21) Appl. No.: 13/478,776

(22) Filed: May 23, 2012

(65) Prior Publication Data

US 2012/0267845 A1 Oct. 25, 2012

Related U.S. Application Data

(63) Continuation of application No. PCT/EP2010/068052, filed on Nov. 23, 2010.

(30) Foreign Application Priority Data

Nov. 24, 2009 (EP) ..... 09176860

(51) Int. Cl.
*B65H 31/26* (2006.01)

(52) U.S. Cl. ..... 271/220; 271/224

(58) Field of Classification Search ..... 271/314, 271/81, 220–222, 224, 207
See application file for complete search history.

(56) References Cited

U.S. PATENT DOCUMENTS

| | | | | |
|---|---|---|---|---|
| 6,877,739 | B2 * | 4/2005 | Leitz et al. | 271/178 |
| 7,007,946 | B1 | 3/2006 | Dobrindt et al. | |
| 7,607,659 | B2 * | 10/2009 | Fukatsu et al. | 271/220 |
| 7,950,652 | B2 * | 5/2011 | Terao et al. | 271/220 |
| 2002/0180141 | A1 | 12/2002 | Dobrindt | |

FOREIGN PATENT DOCUMENTS

| | | | |
|---|---|---|---|
| DE | 199 57 574 | A1 | 9/2000 |
| EP | 1 762 523 | A2 | 3/2007 |
| FR | 2 760 733 | A1 | 9/1998 |
| JP | 62-70165 | A | 3/1987 |
| JP | 1-261161 | A | 10/1989 |

* cited by examiner

*Primary Examiner* — Prasad Gokhale
(74) *Attorney, Agent, or Firm* — Birch, Stewart, Kolasch & Birch, LLP

(57) ABSTRACT

A sheet stacking device and method of stacking sheets, wherein a first pressing member engages with an edge of a new sheet to be deposited on top of a previously deposited sheet on a sheet receiving plane and presses down the edge, while a second pressing member maintains a pressure onto an edge of the previously deposited sheet. The second pressing member engages with the edge of the new sheet and presses down the edge onto the previously deposited sheet on the receiving plane, while the first pressing member maintains a pressure onto the edge of the new sheet. Thus, the sheets may always be pressed down on the edge by at least one of the first and second pressing members.

13 Claims, 3 Drawing Sheets

SHEET STACKING DEVICE AND METHOD OF STACKING SHEETS

CROSS-REFERENCE TO RELATED APPLICATIONS

This application is a Continuation of International Application No. PCT/EP2010/068052, filed on Nov. 23, 2010, and for which priority is claimed under 35 U.S.C. §120, and which claims priority under 35 U.S.C. §119 to Application No. 09176860.6, filed in Europe on Nov. 24, 2009. The entirety of each of the above-identified applications is expressly incorporated herein by reference.

BACKGROUND OF THE INVENTION

1. Field of the Invention

The present invention relates to the stacking of sheets, e.g. printed sheets. In particular, the present invention relates to a sheet stacking device and a method of stacking sheets.

2. Background of the Invention

In conventional sheet stacking devices, for example, sheets are deposited consecutively onto a sheet receiving plane, thereby forming a stack of deposited sheets. Depositing a sheet may comprise inverting the sheet around an axis of rotation.

From EP 1 762 523 A2, a sheet stacking device is known that comprises a rotatably arranged element for inverting and conveying a sheet onto a receiving plane. At least a portion of a sheet to be stacked is accepted in a slot at the circumferential edge of the rotatably arranged element, and is rotated until it reaches the stop and emerges from the slot while the rotatably arranged element rotates further. In order to restrict the freedom of movement of the edge of any sheets that have already been deposited on the receiving plane, retention hooks are provided for exerting a downwards directed retention force onto the sheet edge.

FR 2 760 733 A1 discloses a similar sheet stacking device with flexible support elements 47a, 47b and fingers 46 for pressing on the upper sheet of the stack.

From DE 199 57 574 A1, an apparatus and method for depositing sheets on a stack are known. Tongues, a hold-down, and rollers are used for pressing on a top sheet of a stack. While the tongues and the hold-down are positioned on top of the stack, a new sheet is advanced onto the stack by the rotation of the rollers. While the sheet is held by the rollers against the tongues, the hold-down is lifted and placed onto the new sheet on top of the stack. Afterwards, the rollers and the tongues are lifted off the stack, and the tongues are placed on top of the stack, again.

SUMMARY OF THE INVENTION

It is an object of the present invention to provide a sheet stacking device or a method of stacking sheets that allows drastically increasing the speed of stacking sheets.

In particular, it would be desirable to be able to stack sheets wherein sheets are allowed to not yet be completely laid to rest on a stack of sheets once a new sheet is conveyed onto the stack.

According to the present invention, in order to achieve the above object, there is provided a sheet stacking device, comprising: a sheet receiving plane for supporting stacked sheets; a sheet depositing member for depositing the sheets onto the sheet receiving plane; and at least one first pressing member and at least one second pressing member, each arranged for releasing an edge of a previously deposited sheet and pressing down an edge of a new sheet onto said previously deposited sheet above the receiving plane, wherein the at least one second pressing member is adapted to release an edge of a sheet and to engage with a new sheet with a time delay with respect to the at least one first pressing member such that: the at least one first pressing member releases said edge of a previously deposited sheet while the at least one second pressing member presses down said edge, and the at least one second pressing member releases said edge of a previously deposited sheet, while the at least one first pressing member presses down said edge of a new sheet onto said previously deposited sheet, and wherein the at least one second pressing member is adapted to be retracted from a sheet engaging position in a direction towards, and optionally beyond, a stop member for aligning said edge of said previously deposited sheet.

In particular, engaging with a sheet comprises positioning the respective pressing member above said edge of the sheet in a position for pressing down on said edge.

The term "releasing an edge of a sheet," or shortened to "releasing a sheet," is to be understood as setting free the top side of the sheet at said edge from the engagement by the respective pressing member.

For example, the at least one second pressing member is controllable to release a sheet and to engage with a new sheet with a time delay with respect to the at least one first pressing member. For example, the sheet stacking device further comprises a control unit for controlling the at least one second pressing member and/or the at least one first pressing member in the described manner.

Since the at least one first pressing member is arranged for not only pressing down an edge of a new sheet onto a previously deposited sheet, but also for releasing an edge of said previously deposited sheet, in particular releasing said edge before pressing down an edge of a new sheet, a pressing force exerted by the at least one first pressing member may be chosen as required for reliably holding down an edge of a stack of sheets. It is not required to limit said pressure force in order to be able to insert a new sheet below the first pressing member while the first pressing member still presses down the edge of the previously stacked sheets. Thus, the alignment of stacked sheets may be improved.

Furthermore, since the at least one second pressing member may be operated with a time delay with respect to the at least one first pressing member, for example, the at least one first pressing member may be brought into a position ready for engaging with a new sheet to be deposited, while the at least one second pressing member still presses down the edge of any sheets on the receiving plane. Thus, there is more time available for the previous sheet to approach or even assume a state of rest while still being kept aligned under the pressing force of said at least one second pressing member. Thus, the alignment of the stacked sheets may be improved.

Useful details of the invention are indicated in the dependent claims.

Preferably, the at least one second pressing member is adapted to release a sheet and to engage with a new sheet with a time delay with respect to the first pressing member, in order to enable the at least one first pressing member to engage with an edge of a new sheet, while the at least one second pressing member maintains a pressure onto the edge of the previously deposited sheet. Engaging with an edge of a new sheet by the at least one first pressing member may comprise moving of said at least one first pressing member in an engaging position for pressing down an edge of a new sheet. Thus, a time during which an edge of a previously deposited sheet is under the influence of a pressing force may be increased. Thus, the quality of sheet alignment of the sheet stacking device may be increased.

For example, the at least one second pressing member is adapted to be retracted from a sheet engaging position in a direction substantially parallel to the sheet receiving plane, e.g. in a substantially horizontal direction. A sheet engaging position is to be understood as a position, in which the at least one second pressing member is arranged for pressing down onto the edge of the previously deposited sheet. Retracting the at least one second pressing member in a direction substantially parallel to the sheet receiving plane, or, in particular, in a direction substantially parallel to the plane of any stacked sheets on the receiving plane, has the advantage that the space above the stack of sheets that is required for retracting the at least one second pressing member is minimized This is especially advantageous if an edge of a new sheet is already deposited onto the previously deposited sheet while the at least one second pressing member is retracted.

The at least one second pressing member is adapted to be retracted from a sheet engaging position in a direction towards, and optionally beyond, a stop member for aligning said edge of said previously deposited sheet. For example, said stop member is arranged at an end of the sheet receiving plane for aligning stacked sheets on the sheet receiving plane. By retracting in the described direction, it is avoided that during retracting, the at least one second pressing member exerts a force on the upper side of said previously deposited sheet in any direction other than towards the stop member. Thus, for example, a sideward movement of said sheet may be avoided. Furthermore, the at least one second pressing member may comprise a friction element for exerting a frictional force on the upper side of said previously deposited sheet in a direction towards said stop member while retracting. Thus, alignment of the sheet may be improved.

Preferably, the at least one second pressing member is substantially flat. Thus, when an edge of a new sheet is placed on top of the previously deposited sheet and on top of the at least one second pressing member, a flat shape of the at least one second pressing member enables the edge of the new sheet to assume a configuration that is as flat as possible in spite of the at least one second pressing member still being positioned between the edges of the previously deposited sheet and the new sheet. Thus, a distortion of the configuration of the edge of the new sheet as the at least one second pressing member is retracted from its sheet engaging position may be minimized.

The at least one second pressing member is adapted to release a sheet and to engage with a new sheet with a time delay with respect to the at least one first pressing member such that: the at least one first pressing member releases said edge of a previously deposited sheet, while the at least one second pressing member presses down said edge, and the at least one second pressing member releases said edge of a previously deposited sheet, while the at least one first pressing member presses down said edge of a new sheet onto said previously deposited sheet. Thus, each pressing member does not release said edge of a previously deposited sheet until the other one of the at least one first and second pressing members again exerts a pressing force onto the edge of any stacked sheets. Thus, the edge of any topmost sheet may always be reliably held in its place independent of any unrolling movement of other parts of one or more of the sheets, for example. Furthermore, continuously exerting a pressing force onto the edge of any stacked sheets prevents a rocking motion of the stack that could otherwise be caused, e.g. in the case of a slightly curled stack.

For example, the sheet stacking device further comprises a control unit that controls a timing of the at least one first pressing member and the at least one second pressing member releasing an edge of a previously deposited sheet and pressing down an edge of a new sheet dependent on media dependent parameters of a sheet medium. For example, the sheet stacking device may comprise a lookup-table, comprising said media dependent parameters for different sheet media. Thus, the timing is variable depending on said media dependent parameters. Thus, the sheet stacking speed may be maximized dependent on the parameters of the medium of the sheets.

In one embodiment, the sheet stacking device comprises a sheet inverting device, wherein the sheet depositing member is a sheet inverting element for inverting a sheet around an axis of rotation onto the sheet receiving plane. Here, the above mentioned advantages of the present invention are of particular importance for the following reason. When a sheet is inverted around an axis of rotation, a leading edge of the sheet may be deposited early on the sheet receiving plane while the trailing part of the sheet, e.g. rolls out onto the receiving plane. Thus, a leading edge of a new sheet may be deposited on the sheet receiving plane, for example, while the previously deposited sheet has not yet assumed a state of rest.

In a further aspect of the invention, there is provided a method of stacking sheets on a sheet receiving plane, comprising: receiving at least an edge of a new sheet on top of a previously deposited sheet on a sheet receiving plane; engaging with said edge of said new sheet and pressing down said edge onto the previously deposited sheet on the receiving plane by at least one first pressing member, while at least one second pressing member maintains a pressure onto an edge of the previously deposited sheet; retracting the at least one second pressing member from a sheet engaging position in a direction towards a stop member and engaging with said edge of said new sheet and pressing down said edge onto the previously deposited sheet on the receiving plane, while the at least one first pressing member maintains a pressure onto said edge of the new sheet; and depositing the new sheet on top of the previously deposited sheet.

The advantages are evident from the above explanations.

For example, at least said edge of a new sheet is received on top of an immediately preceding deposited sheet on a sheet receiving plane before said preceding deposited sheet assumes a state of rest. Thus, stacking speed may be increased drastically.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
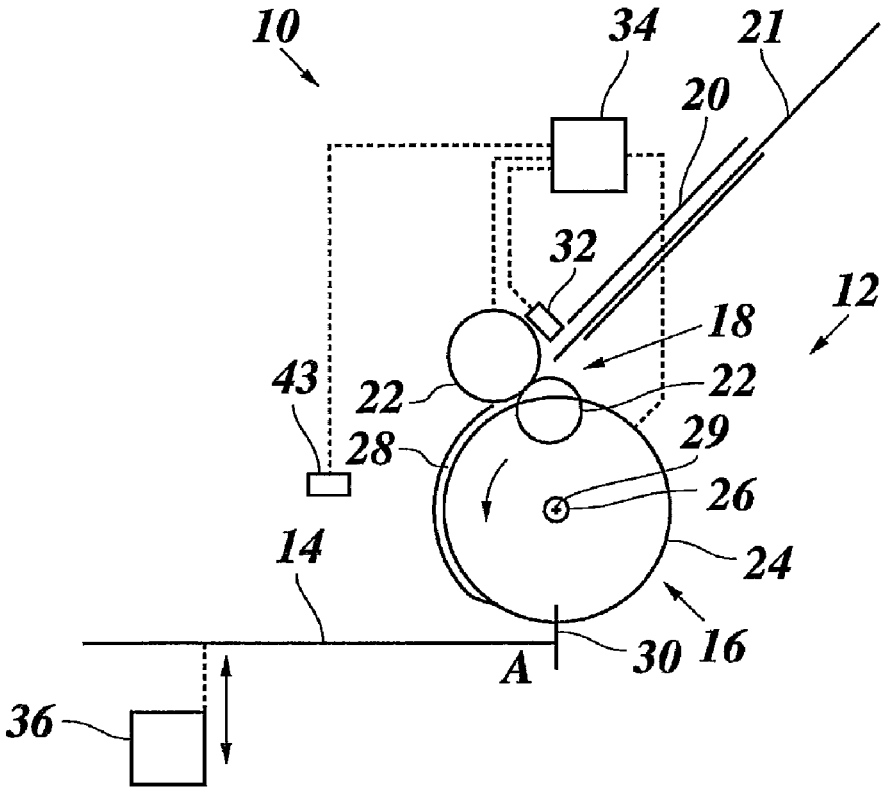
FIGS. 1 and 2 are diagrams of side views of a sheet stacking device according to the present invention in different phases of operation.

The present invention will now be described with reference to the accompanying drawings, wherein the same or similar elements are identified with the same reference numeral.

FIG. 1 is a diagram showing a sheet stacking device 10 including a sheet inverting device 12 and a sheet receiving member in the form of a sheet receiving plane 14 for stacking sheets thereon. The sheet inverting device 12 includes a sheet depositing member in the form of a sheet inverting element 16 and a feeding unit 18 for feeding a sheet to the sheet inverting element 16.

For example, a sheet input path 20 is arranged so that a sheet 21 may be supplied along the sheet input path 20 to the feeding unit 18. For example, sheets may be accepted from a printing device that may be coupled to the sheet stacking device 10. For example, the feeding unit 18 comprises first and second feeding rollers 22, between which a feeding nip is formed for frictionally transporting a supplied sheet 21 through the feeding nip.

The sheet inverting element 16 comprises rotatably arranged elements 24, which are for example formed by disks arranged on a rotation shaft 26 that is drivable by an electric motor, such as an electric servo motor or a stepping motor. The rotatably arranged elements 24 comprise at least one slot 28 at their outer circumferential contour in which at least a leading part of a sheet 21 may be accommodated. In a rotational position within a first rotation zone of the rotatably arranged elements 24 shown in FIG. 1, the opening of the slot 28 is arranged in front of the feeding unit 18, so that a feeding unit 18 may feed a sheet 21 to the slot 28.

When a sheet 21 is fed to the slot 28, the operation of the sheet inverting device 12 may be described as follows. The leading edge of the sheet 21 is accepted in the slot 28. As the sheet 21 is, at least partially, fed into the slot 28, it is bent and rotated around an axis 29 of rotation of the rotation shaft 26. Then, or concurrently therewith, the rotatably arranged elements 24 are rotated as indicated by an arrow in FIG. 1, and the leading part of the sheet 21 is further rotated around the axis 29 of rotation, until the leading edge of the sheet 21 abuts onto a stop 30 arranged to interfere with the slot 28 as the slot 28 is rotated towards a lower circumferential location of the rotatably arranged elements 24. For example, the stop 30 protrudes from below between the rotatably arranged elements 24.

When the leading edge of the sheet 21 abuts upon the stop 30, and the rotatably arranged elements 24 are rotated further and, depending on the length of the sheet, the sheet 21 is further fed through the feeding unit 18, the sheet 21 is forced to bulge from the circumferential contour of the rotatably arranged elements 24. As the input opening of the slot 28 passes the stop 30, the leading edge of the sheet 21 is released from the sheet inverting element 16 and is received on the receiving plane 14. Thereby, the leading edge of the sheet 21 is aligned by the stop 30 at a near side A of the receiving plane 14.

Figure 2:
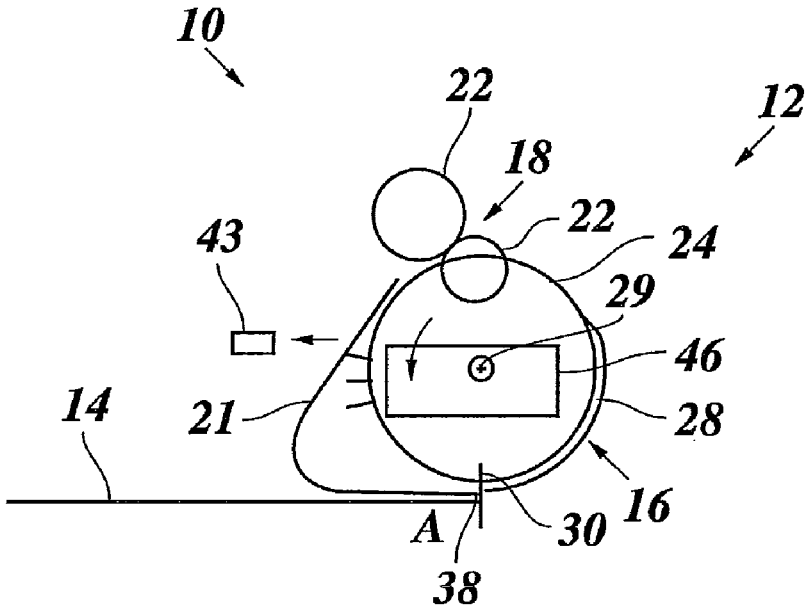

When the sheet 21 is completely fed through the feeding unit 18, as is shown in FIG. 2, the sheet 21 may roll out towards a far side B of the receiving plane 14, thereby assuming a flat configuration on top of the receiving plane 14. The sheet inverting element 16 may be further rotated into the position shown in FIG. 1, ready for accepting the next sheet 21 in the slot 28.

FIG. 1 further shows a sensor 32 arranged at the feeding unit 18 for detecting the arrival of the leading edge of the sheet 21 at the feeding unit 18. The sensor 32 is connected to a control unit 34 that controls the operation of the sheet inverting element 16 and the feeding unit 18.

For example, the stacking device 10 may comprise an elevating device 36 configured to raise and lower the receiving plane 14. Thus, the receiving plane 14 may be lowered as more and more sheets are stacked on the receiving plane 14.

The operation of the sheet stacking device 10 will be described in the following with reference to FIGS. 3 to 7 showing different phases of an operating cycle, i.e. a cycle of depositing a sheet on top of any stacked sheets previously deposited on the receiving plane 14. In FIGS. 3 to 7, five phases of operation are illustrated, each phase being illustrated, in a left part of the respective Figure, by a schematic side view of details of an edge of the deposited sheets, as well as, in a right part of the respective Figure, a schematic illustration of forces exerted onto the edge of the sheets and the position of these forces along said edge. In FIGS. 3 to 7, a stack 37 of sheets is shown on the receiving plane 14.

Figure 3:
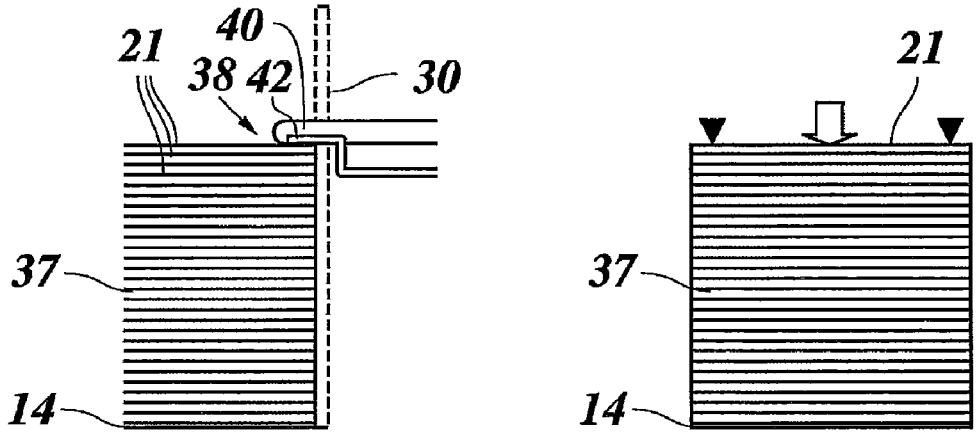
FIG. 3 is a schematic diagram showing, on the left, pressure members of the sheet stacking device in detail, and, on the right, pressure forces exerted by the pressure members.

FIG. 3 shows details of an edge 38 of sheets 21 stacked on the receiving plane 14 and aligned at the stop 30. For example, a first pressing member 40 and two second pressing members 42 are distributed along the edge 38 for exerting a downward pressing force onto an edge 38 part of the sheets 21. The right side of FIG. 3 schematically shows the position along the edge 38, at which the pressing forces are exerted. The pressing force of the first pressing member 40, illustrated by an open arrow, is exerted on the center of the edge 38, when the first pressing member 40 is in its sheet engaging position shown in the left part of FIG. 3. The second pressing members 42 are arranged on both sides of and distant from the first pressing member 40. For example, as is schematically illustrated in the right part of FIG. 3, the second pressing members 42 may exert a pressing force onto the edge 38 near the corners of the topmost sheet 21. However, this position of the second pressing members 42 is chosen for illustrating purposes, in particular. In practice, the second pressing members 42 may be positioned closer to the first pressing member 40, for example. Moreover, the numbers of the first and second pressing members 40, 42 are not limited to those of the described example.

In FIG. 3, the situation of the topmost sheet 21 on the stack corresponds to the situation of the presently deposited sheet 21 as shown in FIG. 2. That is, the edge 38 of the sheet 21 has been deposited on the receiving plane 14 at the stop 30. The first and second pressing members 40, 42 are in their respective sheet engaging position for exerting a pressing force onto the edge 38 in order to keep the sheet 21 in alignment with the stop 30 and, thus, with the edges 38 of the previously stacked sheets 21, as the top most sheet 21 may roll out as illustrated in FIG. 2.

Figure 4:
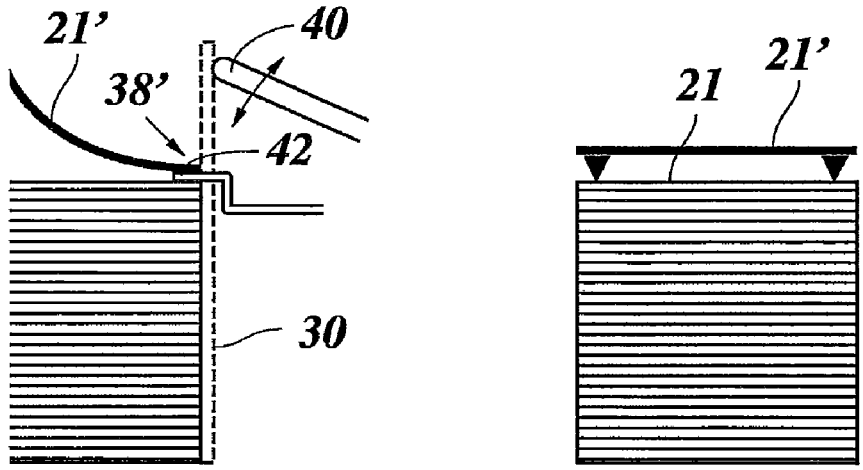
FIGS. 4-7 are diagrams similar to FIG. 3, corresponding to different phases of operation.

While the second pressing members 42 still are in their sheet engaging position for pressing down the edge 38 of the topmost sheet 21 just received, the first pressing member 40 releases said edge 38 and is moved, e.g. lifted, into a position shown in FIG. 4. While the first pressing member 40 is lifted from its sheet engaging position, a new sheet 21' is inverted by the sheet inverting element 16 in the same manner as described above, and its leading edge 38' is deposited on the stack 37 while being aligned by the stop 30. The edge 38' is received on top of the second pressing members 42, which still press down the edge 38 of the previous sheet 21, as is illustrated in the right part of FIG. 4.

Figure 5:
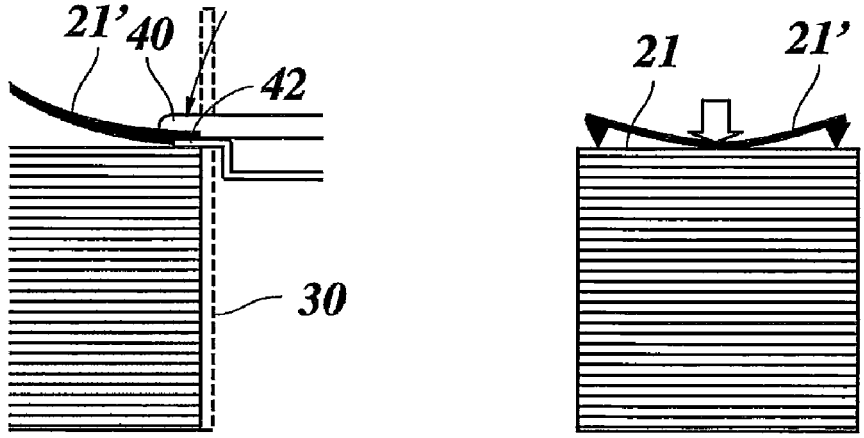

The first pressing member 40 is then moved into its sheet engaging position for pressing down onto the edge 38' of the new sheet 21', as is illustrated in FIG. 5. The first pressing members 40 may perform a back and forth movement, for example in form of a rotation about an axis of rotation, including the retracting movement and an opposite engaging movement. In particular, the engaging movement may follow the same path as the retracting movement.

In the situation of FIG. 5, the second pressing members 42 are between the previous sheet 21 and the new sheet 21', as is, in particular, illustrated in the right part of FIG. 5. The second pressing members 42 are substantially flat. In the right part of FIG. 5, the bending of the edge 38' resulting from the second pressing member 42 still being present below the edge 38' is exaggerated for illustrating purposes.

Figure 6:
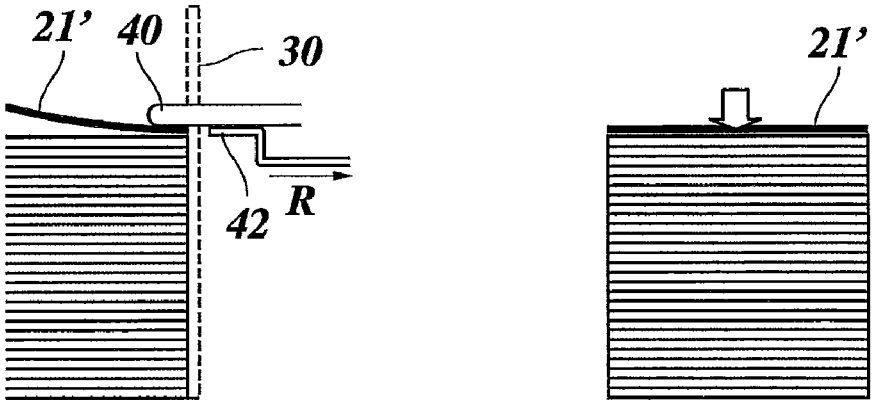

When the first pressing member 40 presses down the edge 38', the second pressing members 42 are retracted from their sheet engaging position in a direction R towards the stop 30, as is indicated in FIG. 6. Thereby, the edge 38 of the previous deposited sheet 21 is released. However, as is indicated in the right part of FIG. 6, the first pressing member 40 exerts its pressing force onto the edge 38' of the new sheet 21', thereby keeping both sheets 21, 21' aligned at the stop 30.

Figure 7:
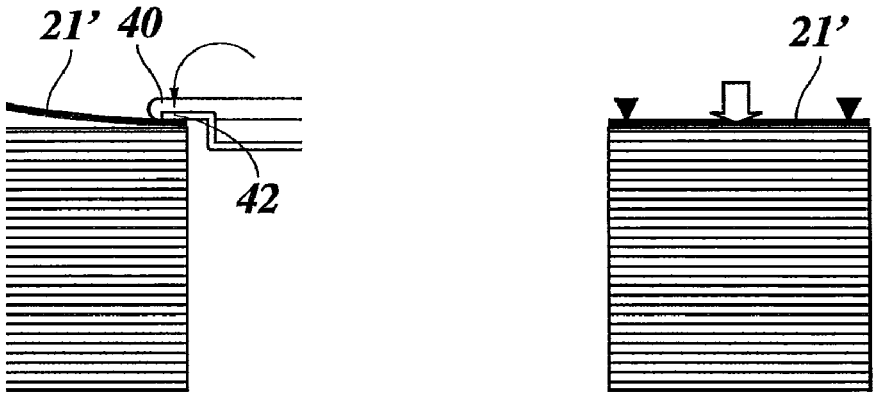

While the first pressing member 40 is still in its engaging position on top of the edge 38', the second pressing members 42 are moved on top of the edge 38' of the new sheet 21', as well. This is shown in FIG. 7. The second pressing members 42 may perform a movement forming a closed loop, for example in form of a rowing movement, including the horizontal retracting movement and an, e.g. semi-circular engaging movement. In particular, the engaging movement follows a different path than the retracting movement. Thus, as is schematically illustrated in the right part of FIG. 7, both the first pressing member 40 and the second pressing members 42 are pressing down onto the edge 38 of the new sheet 21'.

Then, while the sheet 21' may still be rolling out on the receiving plane 14 or, respectively, the stack 37, the described operation steps may be repeated by the first pressing member 40 releasing the edge 38', and a further new sheet being deposited corresponding to the situation of FIG. 4.

During the described operation cycle, the stack 37 will always be pressed down on the side of the edge 38 by at least one of the first pressing member 40 and the second pressing members 42. Thus, an alignment of the sheets 21 may be preserved, and new sheets may be accepted on the stack 37 without requiring that previously received sheets have already assumed a state of rest. Thus, a rolling out process of one or more previous sheets 21 and a rolling out process of a new sheet 21' on the stack 37 may overlap in time.

A timing of the different movements of the first and second pressing members 40, 41 in synchronization with the sheet inverting operation of the sheet inverting device 12 may be controlled, for example, by one or more sensors 43 arranged at the sheet inverting space, such as photo sensors. The sheet inverting space is defined by the space occupied by a sheet during inverting and being deposited on the receiving plane 14.

Figure 8:
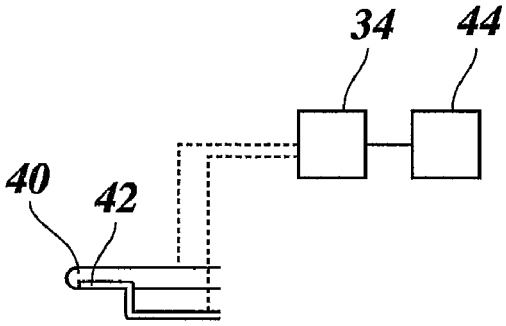
FIG. 8 is a diagram showing a detail of the sheet stacking device of FIG. 1.

Additionally or alternatively, the timing may be controlled dependent on media dependent parameters of a sheet medium. For example, as is schematically illustrated in FIG. 8, the control unit 34 may be arranged to control the movement of the first and second pressing members 40, 42, and the control unit 34 may have access to a lookup-table 44 containing parameters of the timing. For example, the lookup-table 44 may comprise parameters for different types of sheets. For example, parameters may be provided depending on a weight of the sheet, a material of the sheet such as paper or synthetic resin, and/or a thickness of the sheet. For example, a suitable timing may be determined by experiment, and the determined parameters may be stored in the lookup-table 44.

As is indicated by dashed lines in FIG. 2, the sheet inverting device 12 may further comprise an air flow generator 46 for generating an air flow against that side of the presently inverting sheet which faces the sheet inverting element 16. Thus, rolling out of thin, weak, or limp sheets may be facilitated and accelerated.

The described sheet stacking device may provide a high stacking quality even at largely increased stacking and inverting speeds.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet stacking device, comprising:

a sheet receiving plane for supporting stacked sheets;

a sheet depositing member for depositing sheets onto the sheet receiving plane; and at least one first pressing member and at least one second pressing member, each arranged for releasing an edge of a previously deposited sheet and pressing down an edge of a new sheet onto said previously deposited sheet above the receiving plane, wherein the at least one second pressing member is adapted to release a sheet and to engage with a new sheet with a time delay with respect to the at least one first pressing member such that:

the at least one first pressing member releases said edge of a previously deposited sheet while the at least one second pressing member presses down said edge, and the at least one second pressing member releases said edge of a previously deposited sheet while the at least one first pressing member presses down said edge of a new sheet onto said previously deposited sheet, and wherein the at least one second pressing member is adapted to be retracted from a sheet engaging position in a direction towards a stop member for aligning said edge of said previously deposited sheet.

2. The sheet stacking device according to claim 1, wherein the at least one second pressing member is adapted to be retracted from the sheet engaging position in a direction towards and beyond the stop member for aligning said edge of said previously deposited sheet.

3. The sheet stacking device according to claim 1, wherein the at least one second pressing member is adapted to release a sheet and to engage with a new sheet with a time delay with respect to the first pressing member in order to enable the at least one first pressing member to engage with an edge of a new sheet, while the at least one second pressing member maintains a pressure onto the edge of the previously deposited sheet.

4. The sheet stacking device according to claim 1, wherein the at least one second pressing member is adapted to be retracted from a sheet engaging position in a substantially horizontal direction.

5. The sheet stacking device according claim 1, wherein the at least one second pressing member is substantially flat.

6. The sheet stacking device according to claim 1, further comprising a control unit that controls a timing of the at least one first pressing member and the at least one second pressing member releasing an edge of a previously deposited sheet and pressing down an edge of a new sheet dependent on media dependent parameters of a sheet medium.

7. The sheet stacking device according to claim 1, further comprising a sheet inverting device, wherein the sheet depositing member is a sheet inverting element of the sheet inverting device for inverting a sheet around an axis of rotation onto the sheet receiving plane.

8. A printing device, comprising the sheet stacking device according to claim 1.

9. A method of stacking sheets on a sheet receiving plane, comprising the steps of:

receiving at least an edge of a new sheet on top of a previously deposited sheet on the sheet receiving plane;

engaging with said edge of said new sheet and pressing down said edge onto the previously deposited sheet on the receiving plane by at least one first pressing member, while at least one second pressing member maintains a pressure onto an edge of the previously deposited sheet;

retracting the at least one second pressing member from a sheet engaging position in a direction towards a stop member and engaging with said edge of said new sheet and pressing down said edge onto the previously deposited sheet on the receiving plane by the at least one second pressing member, while the at least one first pressing member maintains a pressure onto said edge of the new sheet; and depositing the new sheet on top of the previously deposited sheet.

10. The method according to claim 9, wherein at least said edge of a new sheet is received on top of an immediately preceding deposited sheet on the sheet receiving plane before said preceding deposited sheet assumes a state of rest.

11. The method according to claim 9, wherein:

the at least one first pressing member releases said edge of a previously deposited sheet, while the at least one second pressing member presses down said edge; and the at least one second pressing member releases said edge of a previously deposited sheet while the at least one first pressing member presses down said edge of a new sheet onto said previously deposited sheet.

12. The method according to claim 9, wherein a timing of the at least one first pressing member and the at least one second pressing member releasing an edge of a previously deposited sheet and pressing down an edge of a new sheet is controlled dependent on media dependent parameters of a sheet medium.

13. The method according to claim 9, further comprising the step of inverting the sheets around an axis of rotation onto the sheet receiving plane.

* * * * *